US010035567B1

(12) United States Patent
Baker

(10) Patent No.: US 10,035,567 B1
(45) Date of Patent: Jul. 31, 2018

(54) ANCHORING SYSTEMS

(71) Applicant: Michael L Baker, Pequot Lakes, MN (US)

(72) Inventor: Michael L Baker, Pequot Lakes, MN (US)

( * ) Notice: Subject to any disclaimer, the term of this patent is extended or adjusted under 35 U.S.C. 154(b) by 0 days.

(21) Appl. No.: 15/796,719

(22) Filed: Oct. 27, 2017

Related U.S. Application Data

(63) Continuation-in-part of application No. 15/170,911, filed on Jun. 1, 2016.

(60) Provisional application No. 62/169,659, filed on Jun. 2, 2015.

(51) Int. Cl.
*B63B 21/24* (2006.01)
*B63B 21/26* (2006.01)
*B63B 21/30* (2006.01)

(52) U.S. Cl.
CPC ..... *B63B 21/26* (2013.01); *B63B 21/243* (2013.01); *B63B 21/30* (2013.01)

(58) Field of Classification Search
CPC ..... B63B 21/26; B63B 21/30; B63B 21/243
See application file for complete search history.

(56) References Cited

U.S. PATENT DOCUMENTS 7,302,904 B2 * 12/2007 Burns ..... E04H 15/62 114/294
7,870,829 B1 * 1/2011 Perry ..... B63B 21/26 114/230.1
8,312,832 B1 * 11/2012 Camp ..... B63B 21/26 114/294
9,187,954 B1 * 11/2015 Parsons ..... E06C 7/48
2014/0041195 A1 * 2/2014 Hoang ..... B25B 7/12 29/434
2016/0244129 A1 * 8/2016 Cromartie ..... B63B 21/26

* cited by examiner

*Primary Examiner* — Stephen P Avila

(57) ABSTRACT

A system for anchoring a floating object (e.g., watercraft) to the terrain forming of a body of water (e.g., bottom of lake). More particularly, the system provides an anchoring system that allows a rigid support structure to be configured between the anchor point and the watercraft, thereby fixing the watercraft in a constant position.

3 Claims, 8 Drawing Sheets

ANCHORING SYSTEMS

The present application is related to and claims priority from U.S. non-provisional application Ser. No. 15/170,911, filed Jun. 1, 2016, entitled "ANCHORING SYSTEMS", which claims priority to U.S. provisional application 62/169,659, filed Jun. 2, 2015, entitled "ANCHORING SYSTEMS." The contents of both applications are incorporated herein by reference and are not admitted to be prior art with respect to the present invention by the mention in this cross-reference.

BACKGROUND

The various embodiments of the present system relate generally to an anchor system. More particularly, the various embodiments of the present anchor system relate to providing an anchoring mechanism for anchoring a watercraft (or any type of floating object) to the terrain bowl (e.g., bottom) that forms a body of water.

SUMMARY

In accordance with various embodiments hereof, the present apparatus provides an anchor system comprising an anchor assembly; wherein the anchor assembly includes a cork screw assembly; at least one rigid support member; and at least one mechanism for securing the at least one rigid support member to a watercraft. In several embodiments, the anchor assembly also includes a heim joint within the at least one mechanism for securing the at least one rigid support member to a watercraft.

Furthermore, it provides each and every novel feature, element, combination, step and/or method disclosed or suggested by this patent application.

DETAILED DESCRIPTION

The present anchor system primarily relates to an anchor system for anchoring a boat to the terrain forming the basin (e.g., floor) of a body of water (e.g., sea, lake, pond, marsh, etc.). It should be understood that the anchoring system may be used to attach to any terrain or flora, and should not be limited to the generally horizontal bottom of a body of water. In its broadest application, the anchoring system may be attached to any terrain for the purpose of securing any floating object from movement, regardless if the object is floating in the water, floating but partially submersed, or floating above the bottom but yet fully submersed.

Figure 1:
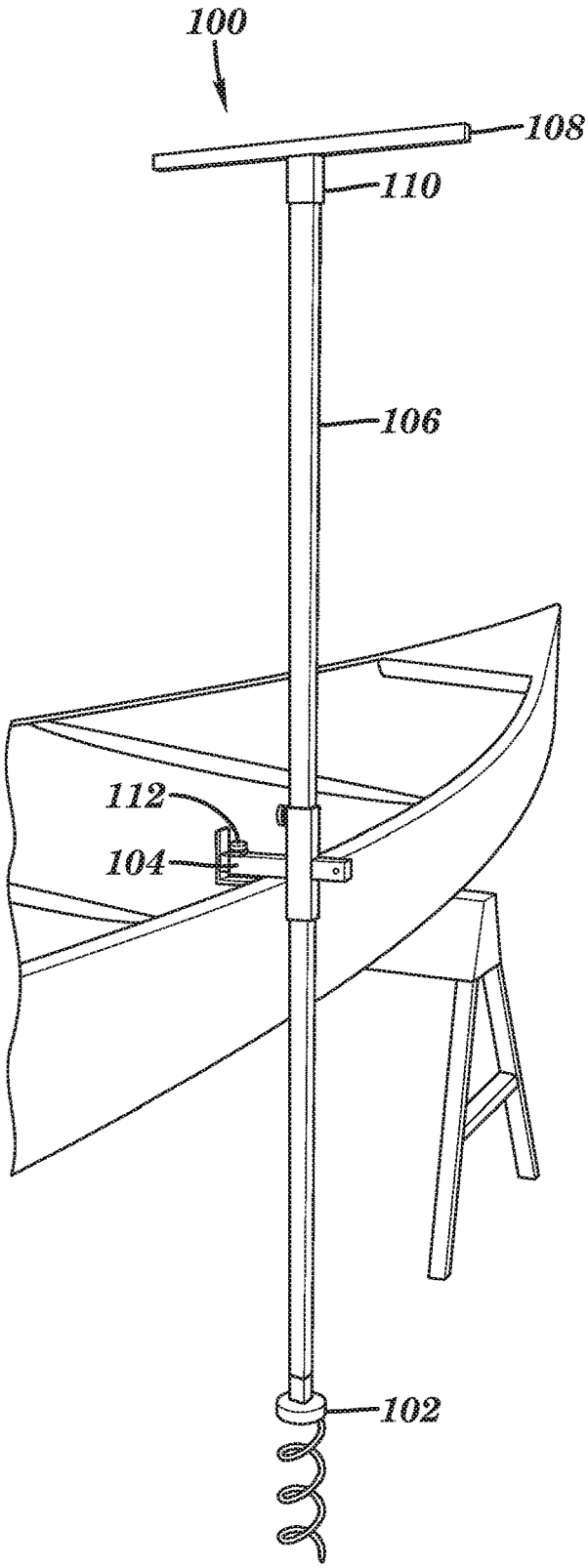
FIG. 1 shows an illustrative view of an anchor assembly according to various embodiments of the present system.

As shown in FIG. 1, the anchor system 100 comprises at least one anchor assembly 102. At least one anchor assembly 102 engages with the terrain forming the bottom of a body of water. In various embodiments, the at least one anchor assembly 102 is structured and arranged with at least one corkscrew section for anchoring the at least one anchor assembly 102 with the terrain. Also shown in FIG. 1, and optionally found in various embodiments, the at least one anchor assembly 102 is attached to a rigid support member, 106. Various methods may be used to attach at least one anchor assembly 102 to at least one rigid support member, 106. As shown, a sleeve and screw are used to bind the anchor assembly and rigid support member together. The corkscrew section engages the terrain by being screwed into the ground by the user. It most applications, the user will be installing the at least one anchor assembly 102 into the terrain while being onboard the watercraft/floating object. In many embodiments, the at least one anchor assembly 102 comprising at least one corkscrew section are structured predominately of metal, including steel or aluminum, or various alloys using such metals. It should be understood that suitable alternatives to such metals exist, including without limitation carbon fiber, acrylics, various polymers, etc. As shown in FIG. 1, and optionally found in various embodiments, anchor system 100 comprises at least one mechanism for mounting at least one rigid support member to another object, as shown in this case by a canoe. The mounting mechanism may be configured on any mechanism known to one of ordinary skill in the art. As shown if FIG. 1, the at least one mounting mechanism is comprised of at least one sleeve to receive at least one rigid support member 106, and further, includes at least one mechanism, 104, for binding the at least one mounting mechanism to the exemplary canoe, as shown.

Figure 2:
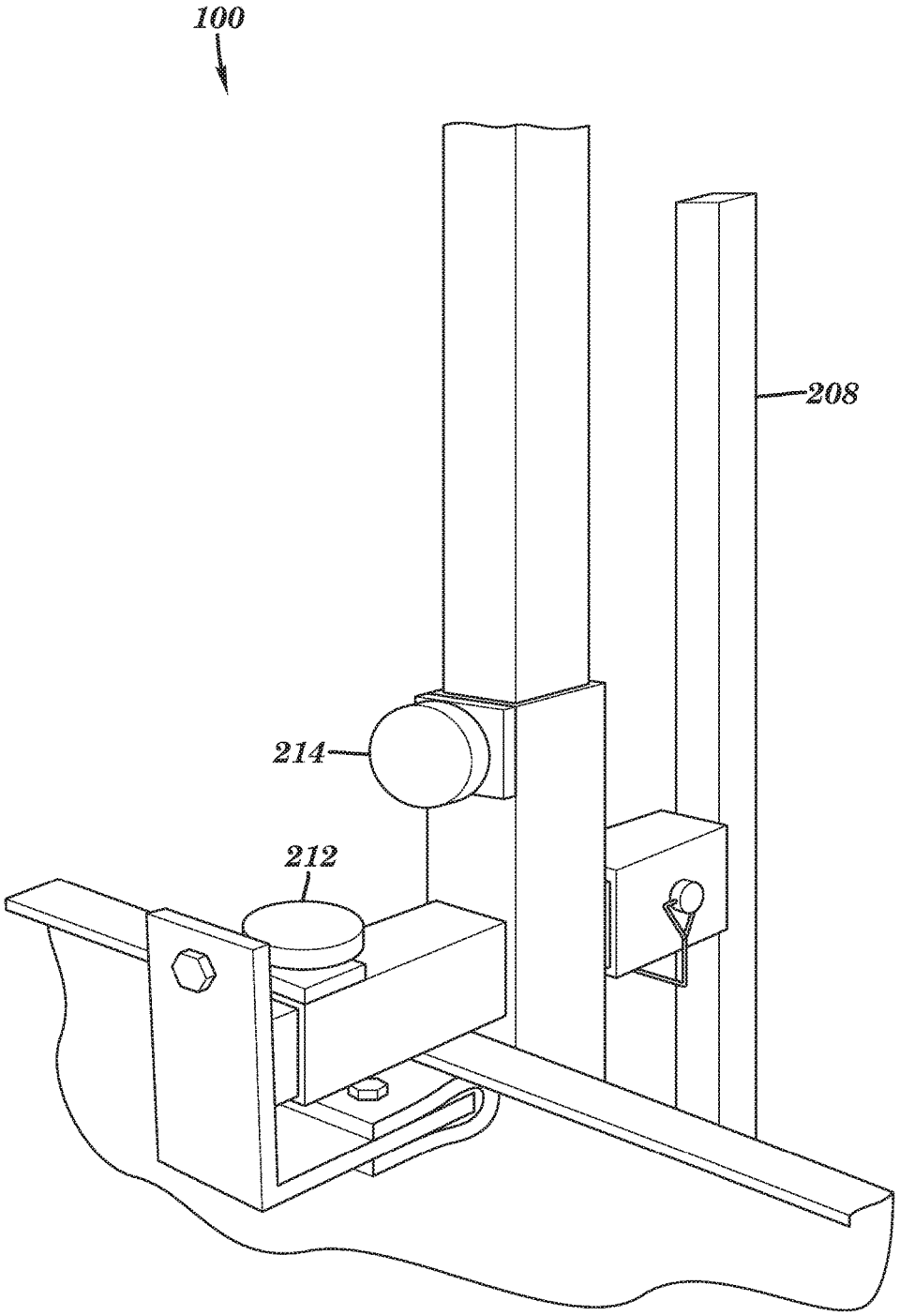
FIG. 2 shows an illustrative view of an anchor assembly attachment system, according to the various embodiments deriving from FIG. 1.

As shown in FIG. 2, an anchor system 100 is bound to the exemplary canoe by at least one tensioning system, a boat clamp mechanism 212. It should be understood that any mounting system may be used. Further, the mounting system may be permanently attached, and even further, pivot and/or extend as necessary to transition from a stored position to an anchoring position. In this illustrative example, the mounting system is structured and arranged to bind to the L-shaped lip of various canoes. In some applications, the rigid support member may also rotate within a sleeve of the mounting mechanism (e.g., both rigid support member and mounting sleeve are round, allowing for turning). Also shown, at least one support member clamp mechanism 214 binds at least one support member. In some embodiments, the support member clamp mechanism includes a sleeve that is tensioned to the support member with an attached knob. A similar method may be used to bind the mounting mechanism to the lip of the canoe. Again, it should be understood that numerous mounting systems may be used with the anchoring system, especially when adapting the anchor system 100 to the numerous amount of different mounting configuration requirements. Also shown in FIG. 2, and optionally found in various embodiments, a T-handle, 208, may be stored in an various locations. A T-handle, 208, may be mounted on the rigid support member 106 and in order to assist with the screwing of the anchor system. It should be understood that various mechanisms may be used to create a screwing motion, including the T-handle as shown, or any other hand operated lever mechanism. It should also be understood that the system may use a motor and/or various gear systems to create the screwing motion in addition to or in lieu of a hand-operated method.

Figure 3:
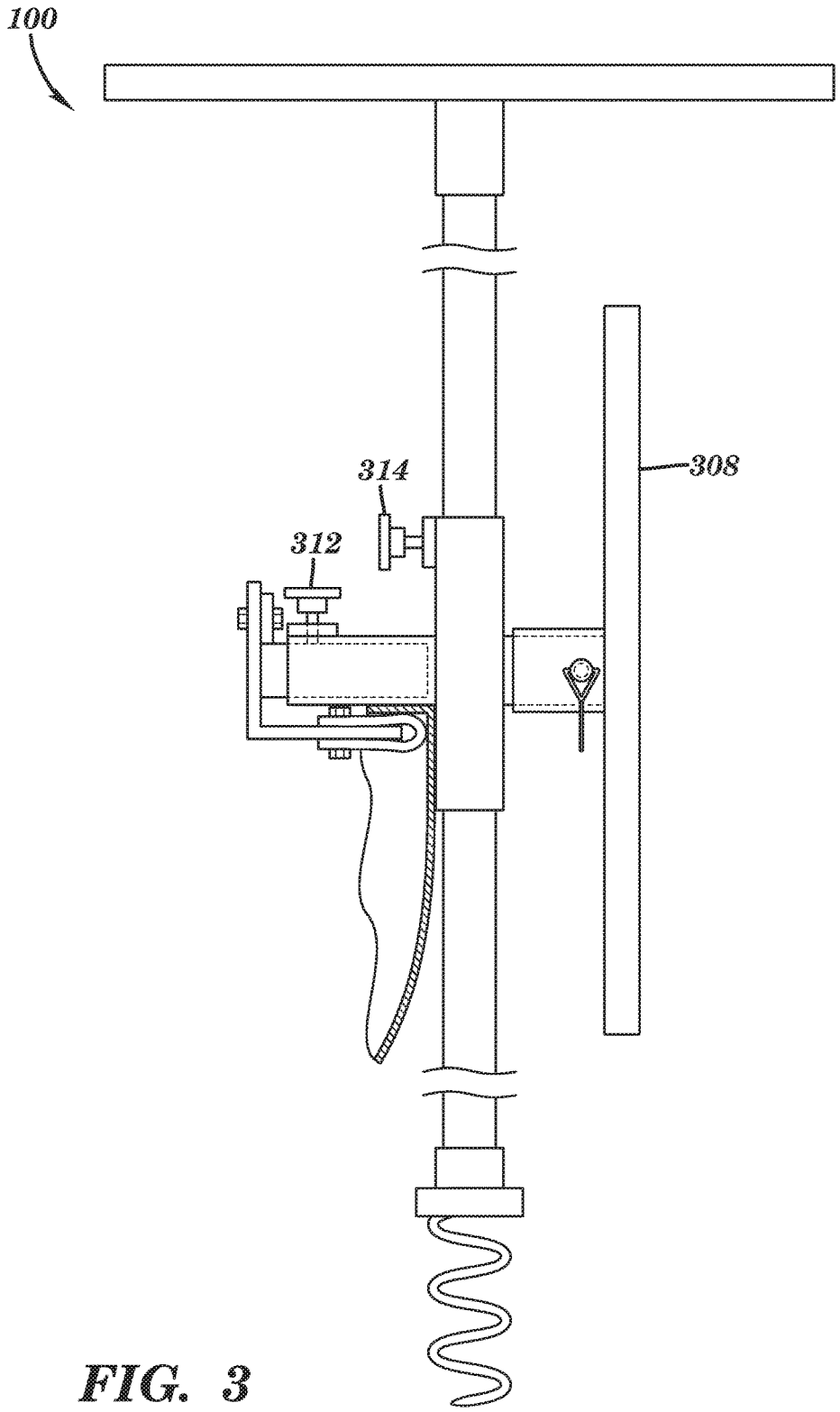
FIG. 3 is an orthogonal view, showing further detail of the anchor assembly attachment system, according to the various embodiments deriving from FIG. 1.

As shown in FIG. 3, the rigid support member may extend to adapt to various lake depths. It should be understood that the rigid support member may comprise multiple rigid support members (not shown). In some embodiments, not shown, the multiple rigid support members may comprise dimensions that allow at least one of the individual rigid support members to fit within side a separate rigid support member. In this configuration, the multiple rigid support members may telescope to both lengthen and shorten. Any known mechanism may be used to facilitate the telescopic action of the multiple rigid support members. It should be understood that a telescoping system is only exemplary, and any mechanism known to one of ordinary skill may be used to create a rigid support member that is sufficiently rigid to anchor a watercraft but also has features to allow it to compact and/or store more conveniently.

Figure 4:
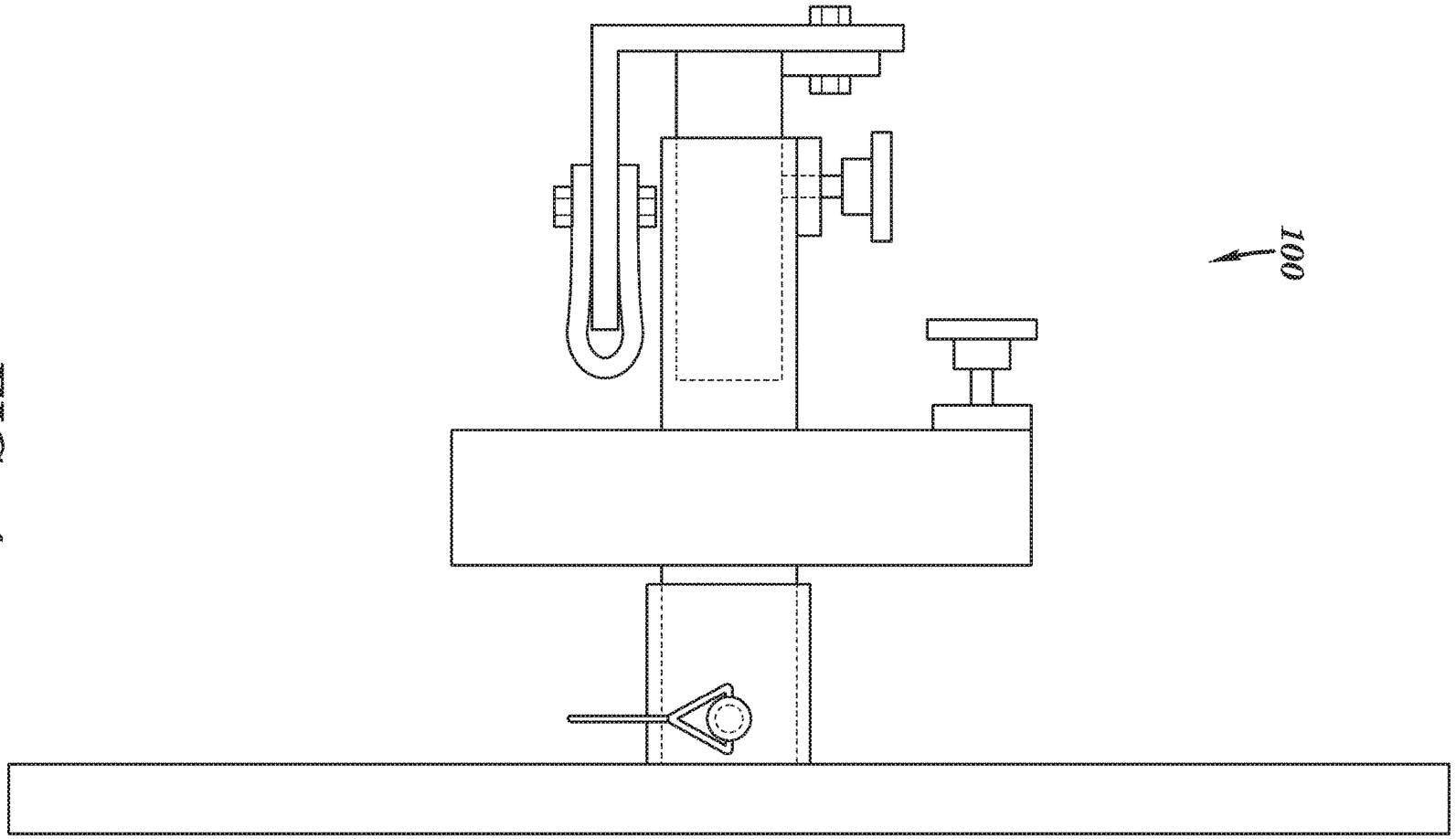
FIG. 4 is an orthogonal view, showing further details of a slotted aperture, according to the various embodiments deriving from FIG. 1.
Figure 5:
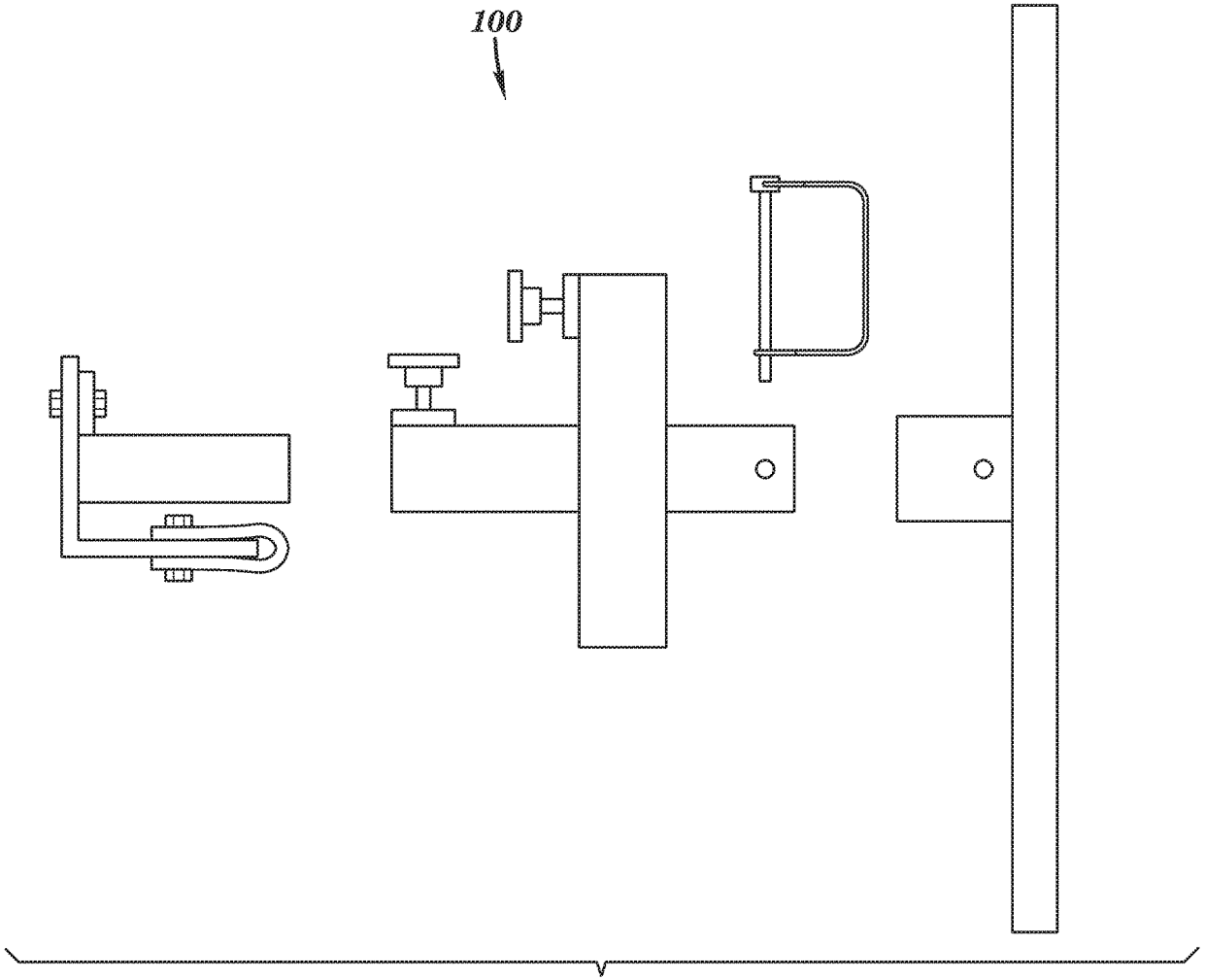
FIG. 5 is a perspective view of components that may be combined to form an anchor assembly attachment system, according to the various embodiments deriving from FIG. 1.

FIG. 4 and FIG. 5 illustrate the exemplary components of an illustrated embodiment. For example, a L-shaped clamp 410 may be compressed to attach the anchoring system to the floating structure.

Figure 6:
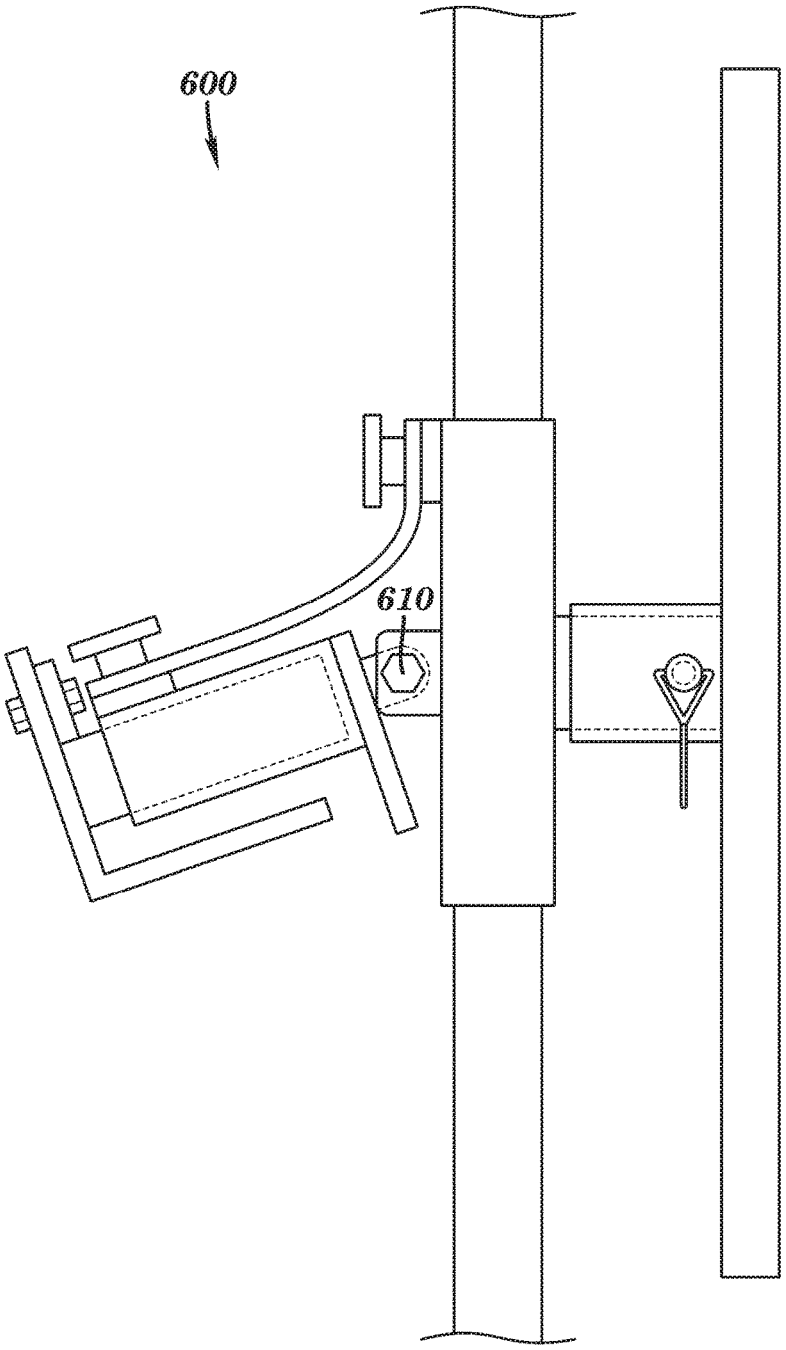
FIG. 6 is an orthogonal view of components that may be combined to form an anchor assembly attachment system, according to the various embodiments deriving from FIG. 1.

FIG. 6 illustrates another mounting system 600 for mounting, in which the mounting system includes at least one pivot 610 for allowing movement of the floating structure in response to water movement (e.g., in response to waves, etc.).

Figure 7A:
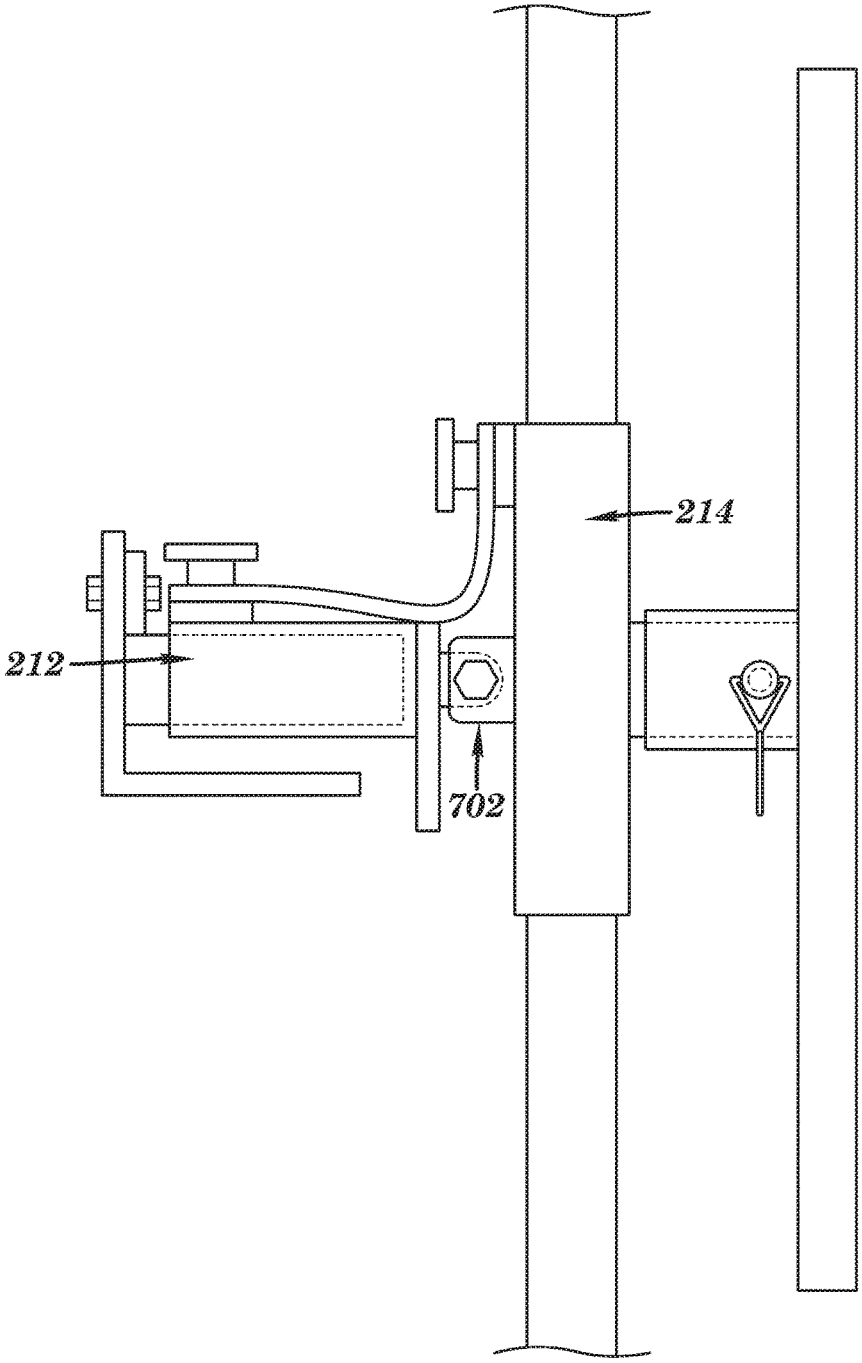
FIGS. 7A & 7B is a perspective view and an orthogonal view of a heim joint structured between a boat clamp mechanism and a support member clamp mechanism, according to the various embodiments deriving from FIG. 1.
Figure 7B:
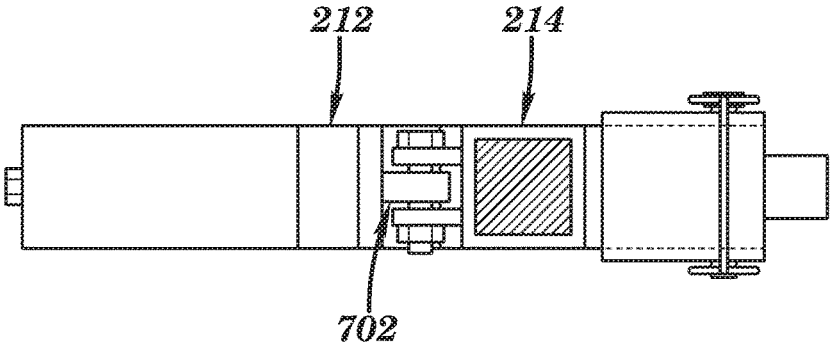

FIGS. 7A & 7B is a perspective view and an orthogonal view of a heim joint structured between a boat clamp mechanism and a support member clamp mechanism, according to the various embodiments deriving from FIG. 1. It should be understood that heim joint includes or may be substituted with, without limitation: rod end bearing, rose joint, ball joint, or similar pivot that includes a swivel or ball swivel that provides pivot in more than one axis. In many embodiments, and as illustrated in the exemplary embodiment in FIG. 1, the heim joint 702 is located between the boat clamp mechanism (e.g., 212) and the support member clamp mechanism (e.g., 214). The heim joint 702 allows the watercraft to move on top of the surface of the water, at least within the range of the heim joint. For example, an individual anchor assembly attached to the middle sidewall of a watercraft will prevent the watercraft from moving up and down (i.e., no movement along the Z-axis, which is generally coaxial with the rigid support member) at the point of attachment (i.e., middle sidewall) of the anchor assembly to the watercraft. However, because of the heim joint 702, the watercraft will still be able to move from from waves on the surface of the water (X and Y axis). Thus, the heim joint prevents structural failure of the clamp mechanism between the watercraft and the rigid support member. It has been found that one anchor assembly clamped on one watercraft sidewall near the front ⅓ of the watercraft and another anchor assembly clamped on the other watercraft sidewall near the back ⅓ of the watercraft provides for a stable watercraft that allows a user (occupant) to stand securely while still allowing the watercraft to move enough to prevent structural fatigue at either clamp mechanism. A single anchor assembly attached to the watercraft sidewall near the middle of the watercraft also provides a generally stable platform, but the watercraft may move up and down at helm and stern, pivoting around the heim joint within the anchor assembly.

It should be further understood that a person having ordinary skill in the art may purposefully design any one of the above various embodiments without one or more of the above features disclosed herein (and thereby creating a negative limitation). Embodiments that do not include all features disclosed herein are included as options in order to improve efficiency, reduce cost, and/or differentiate the various embodiments of the present system from competitors.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. An anchor system comprising:

an anchor assembly;

wherein the anchor assembly includes a cork screw assembly;

at least one rigid support member; and at least one clamp for attaching the at least one rigid support member to a watercraft; wherein the at least one clamp includes:

a boat clamp mechanism for attaching to the watercraft;

a support member clamp mechanism for attaching to the at least one rigid support member; and a heim joint structured between the boat clamp mechanism and the support member clamp mechanism;

wherein the anchor system substantially prevents the watercraft from moving up or down along the Z axis at the point of attachment of the anchor assembly to the watercraft.

2. The anchor system of claim 1, further comprising:

a detachable T-handle.

3. The anchor system of claim 1, wherein the at least one clamp is structured to clamp around the gunwale of the watercraft.

* * * * *